US007408442B2

(12) United States Patent
LeBlanc et al.

(10) Patent No.: US 7,408,442 B2
(45) Date of Patent: Aug. 5, 2008

(54) PROGRAMMABLE EVENT DRIVER/INTERFACE APPARATUS AND METHOD

(76) Inventors: Raymond J. LeBlanc, 10 Metro St., Bristol, CT (US) 06010; Angelo S. Arcaria, 110 Westlook Rd., Wethersfield, CT (US) 06109

( * ) Notice: Subject to any disclaimer, the term of this patent is extended or adjusted under 35 U.S.C. 154(b) by 930 days.

(21) Appl. No.: 10/664,911

(22) Filed: Sep. 22, 2003

(65) Prior Publication Data

US 2005/0067198 A1 Mar. 31, 2005

(51) Int. Cl.
*G08B 5/36* (2006.01)

(52) U.S. Cl. ..... 340/286.11; 340/309.16; 340/311.2; 379/68; 379/101.01; 381/82

(58) Field of Classification Search ..... 340/286.11, 340/311.2, 309.16, 825.24, 692, 870.09, 340/531, 533; 381/82–85; 379/101.01, 68, 379/88.17

See application file for complete search history.

(56) References Cited

U.S. PATENT DOCUMENTS 5,133,081 A * 7/1992 Mayo ..... 455/18
5,406,634 A * 4/1995 Anderson et al. ..... 381/82
5,541,981 A * 7/1996 Lynn ..... 379/88.25
5,761,320 A * 6/1998 Farinelli et al. ..... 381/85
6,433,673 B1 8/2002 Yin et al. ..... 340/384.4
6,856,258 B2 * 2/2005 Kirschner et al. ..... 340/286.11
2003/0063755 A1 * 4/2003 Nourse et al. ..... 381/82

FOREIGN PATENT DOCUMENTS

GB 2243507 A 10/1991
WO 98/49661 11/1998

* cited by examiner

*Primary Examiner*—Thomas Mullen

(57) ABSTRACT

A programmable event driver/interface has timekeeping and scheduling functions and tone and voice capabilities. A software-based interface allows for direct communication with individual annunciators and dynamic grouping of annunciators by zone. System state of health can be ascertained periodically for each annunciator, displayed in a visual summary, stored, and time tagged. Both tones and audio signals such as voice and radio can be commanded to be output by individual annunciators as well as by zones and by all annunciators at once. Schedules, including time-of day, day-of week, and date for annunciator outputs can be programmed for any or all annunciators.

25 Claims, 7 Drawing Sheets

PROGRAMMABLE EVENT DRIVER/INTERFACE APPARATUS AND METHOD

FIELD OF THE INVENTION

The present invention relates generally to signaling and annunciator systems. More particularly, the invention relates to software-driven command and control of remote paging and signaling apparatus.

BACKGROUND OF THE INVENTION

Annunciator and paging systems within such facilities as factories, office buildings, parks, schools, and the like can use electrically activated bells as well as speaker-generated tones to announce normal periodic events such as breaks, shift changes, and other non-emergency events. Such systems are commonly limited to a single sound, in the case of those using mechanical bells, and a range of sounds, in the case of those using speakers and driven from a central audio tone source.

Some annunciator system designs use an individual loudspeaker at each of a multiplicity of locations. In some versions, they are wired in parallel, with each speaker transformer-isolated to permit high transmitter signal voltage at low current, which can reduce copper losses. Other designs may use signals sent from a central source at comparatively low levels, with the annunciators equipped with power supplies and amplifiers driven by local AC power. Systems with multiple zones to be signaled at different times or under different circumstances may be directly wired by zone from a shared control panel. Annunciators wired individually back to a control panel may be activated individually using switches. Volume control may be realized using a central attenuator or an attenuator at each speaker.

A logical extension of the speaker system concepts outlined above may be found in existing digital annunciator systems, which can take advantage of the significant flexibility available to digital systems in general to add features not available in earlier designs. Digital designs can include direct addressing of individual annunciators through a signal distribution system, so that a digital communication processor circuit in an individual annunciator can recognize its own address and respond appropriately.

A representative signal distribution system in use employs RS-485, a standard developed by industry and recognized by the Electronics Industry Association (EIA). RS-485 is a two-wire transmission line communication bus that uses a differential serial data stream for communication between one talker at a time and multiple listeners. RS-485 can be configured to be sufficiently flexible to permit each listener to reply when commanded to do so and to permit multiple talkers to talk in turn, using a scheduling protocol to avoid bus contention. The message bits comprising RS-485 may serve as alert signals, address bits, data bits, and checksums, as well as to be assigned other meanings. Commercial off-the-shelf (COTS) integrated circuits and associated circuitry that can be incorporated into annunciators can recognize RS-485 signal traffic, and can be programmed to recognize their own addresses, to interpret commands sent out on the bus, to execute commands, and to take over the bus to transmit a reply when directed to do so.

Annunciators using RS-485 for communication with a central annunciator control panel can be addressed individually using a variety of addressing systems, including for example switch-selected binary code numbers that are transmitted to select each annunciator individually. Some of these annunciators can be commanded to respond to zone messages; subsequently, commands can address these zones instead of individual annunciators, allowing large groups of annunciators to be activated simultaneously. Some designs permit assignment to zones to be established and changed without need to alter physical wiring within a facility.

Annunciator systems in general emit audible tones when activated from a central location. More capable systems may provide the alternative of emitting prerecorded voice announcements or other brief, locally stored recordings. A nominally digital annunciator design in common use further extends this capability by allowing continuous analog output as well as synthesized tones and short messages. For such an annunciator, digital communication with a base station may be augmented with analog signal distribution on a second wire pair, broadcast, typically amplified at the annunciator, and emitted along with or in place of the annunciator's digitally generated tones.

It would be desirable to have an annunciator system with increased capability and flexibility, to take advantage of the opportunities offered by incorporating computer technology into annunciator systems to a greater extent than has been done heretofore.

SUMMARY OF THE INVENTION

The forgoing needs are met, to a great extent, by the present invention, which in some embodiments provides a software-based annunciator control system installed on a personal computer and connected to an array of annunciators able to receive and transmit digital message transmissions and/or receive analog signals. A preferred embodiment presents a graphical status display representing the properties of each annunciator. For example, the system state can be ascertained periodically for each annunciator, displayed in a visual summary, stored, and time tagged. Both tones and audio signals such as voice and radio can be commanded to be output by individual annunciators as well as by zones and by all annunciators at once. Schedules, including time-of day, day-of week, and date for annunciator outputs can be programmed for any or all annunciators. The software-based interface allows for system expansion including direct communication with individual annunciators and dynamic grouping of annunciators by zone.

In one aspect, a programmable annunciator control system comprises a command routine implemented in stored-sequence executable instructions; a monitor routine implemented in stored-sequence executable instructions; a supervisor routine to evaluate and rank events reported by the monitor routine; a system status report generator implemented in stored-sequence executable instructions; a realtime data backup and storage routine implemented in stored-sequence executable instructions, wherein the realtime data backup and storage routine records a succession of system status reports in the nonvolatile storage, as generated by the system status report generator; and a configuration status display routine for generating a display output representing the commands and system status reports.

In another aspect, a programmable annunciator control system comprises means for communicating between a central control processor and at least one remotely-located annunciator; means for assigning at least one remotely-located annunciator to zones in accordance with user-defined criteria; means for measuring clock time in a form readable by a local central control processor; means for scheduling command events affecting at least one remotely-located annunciator; and means for activating command events affecting at least one remotely-located annunciator.

In yet another aspect, a process for announcing comprises the steps of communicating between a central control processor and at least one remotely-located annunciator; assigning at least one remotely-located annunciator to zones in accordance with user-defined criteria; measuring clock time in a form readable by a local central control processor; scheduling command events affecting at least one remotely-located annunciator; and activating command events affecting at least one remotely-located annunciator.

There have thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
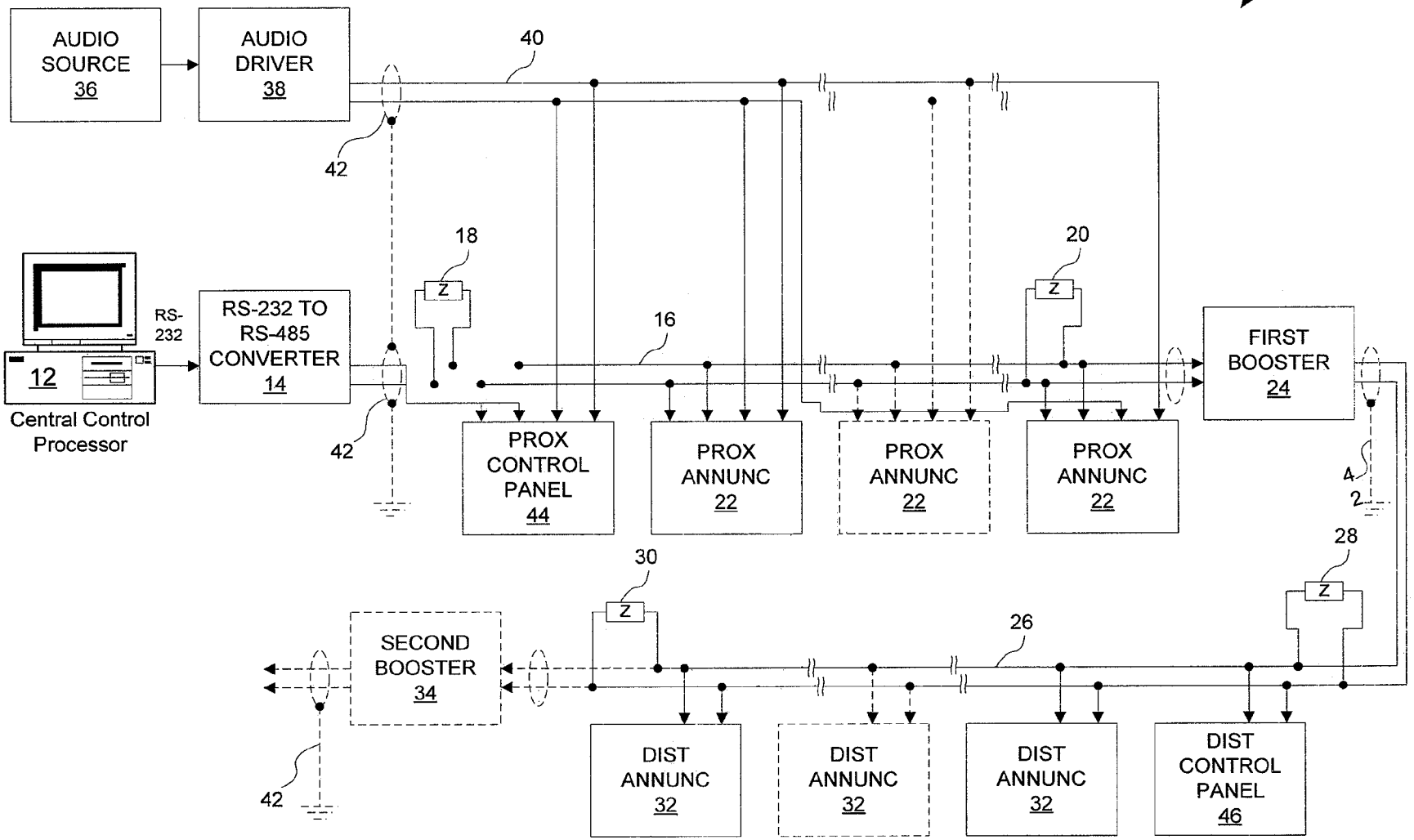
FIG. 1 is an overall block diagram of an annunciator system with a central control processor and multiple remote annunciators.

The invention will now be described with reference to the drawing figures, in which like reference numerals refer to like parts throughout. Embodiments in accordance with the present invention provide a method and apparatus for controlling the output of a set of annunciators in a system controlled by a central control processor.

An exemplary embodiment of the present inventive apparatus and method is illustrated in FIG. 1. FIG. 1 shows an annunciator system 10 in which a central control processor 12 generates signals that are transformed by a transceiver, such as an RS-232 to RS-485 converter 14, that enables the signals to be carried outward on a differential, controlled-impedance transmission line 16 featuring a beginning-of-line termination load 18 and an end-of line termination load 20, until the signals are detected by the receiver section of at least one proximal annunciator 22. Since the transmission system is bidirectional, response signals transmitted by the proximal annunciator 22 can propagate back on the transmission line 16 to the transceiver 14, which transforms the response signals into condition to be detected by the central control processor 12. The termination loads 18 and 20 attenuate reverberation, thus allowing bidirectional communication along a longer transmission line 16, even with the weaker signals likely to be present further from the signal source.

FIG. 1 further shows a first booster 24, driving an extended transmission line 26, which can be equipped with extended-line termination loads 28 and 30 to permit communication with at least one distal annunciator 32, further extending the transmission range from the central control processor 12. The range can be extended further still with a second booster 34, driving additional annunciators, not shown.

FIG. 1 further shows an analog signal source 36 and an audio driver 38, whose outputs, carried on an analog transmission line 40, are received by analog sections of any annunciators 22 and/or 32 for which such functions may be required and installed. Even at a low baud rate, the digital transmission line 16 may carry signal components with comparatively high bandwidth. Because the analog transmission line 40 may carry lower bandwidth signals, the controlled impedance desirable to aid digital transmission line 16 performance may be less critical for the analog line 40. Shielding 42 that can further enhance digital performance and range may provide significant benefit to the analog line 40, however, especially in an electrically noisy environment, where the shielding 42 may reduce induced noise in the analog circuitry of individual annunciators 22 and/or 32.

The exemplary converter 14 shown in FIG. 1 is a differential transceiver, which characteristic increases the noise immunity of the network comprising the converter 14, the transmission line 16, proximal annunciators 22, any boosters 24, any distal annunciators 32, and termination loads 18, 20, 28, and 30. Shielding 42 may lower digital noise, further increasing effective range. A representative multi-drop—that is, having several annunciator loads—differential transceiver system according to the preferred embodiment conforms to EIA standard RS-485. Alternative transceiver hardware embodiments that can have satisfactory performance under some design regimes include IEEE-1394, generally referred to as FireWire®, and others, such as transformer-coupled differential systems and fiber optic-based systems.

The Audio driver 38 may be incorporated into a package with the RS-485 driver, the latter shown in the exemplary system as an RS-232 to RS-485 converter 14. Similarly, the audio source 36 can be incorporated into the central control processor 12, for example using a sound amplifying circuit board or circuit function in an off-the-shelf personal computer used as the central control processor. An external source, such as a microphone or radio receiver, or an internal source, such as Internet radio or prerecorded programming material stored in the central control processor, can be the program source for sound to be emitted by selected annunciators 22 and/or 32.

Analog audio driver output signal levels of 10, 25, and 70 volts are common in annunciator products. These and other levels can be used in the exemplary system by selecting components compatible with the levels chosen. A 1-volt signal output from the audio source 36 feeding the audio driver 38 is a typical example.

Annunciator products that can be used with the exemplary system commonly use loudspeakers to communicate messages, such as tones, prerecorded voice messages, or other forms of audible signals. Lights such as strobe lights, light emitting diodes, or incandescent lamps can augment the communication function of the loudspeakers. Short-range radio transmitters can similarly be used to send sounds, vibrations, or other signals to receivers worn on the persons of individuals who may be unable to detect other annunciator signals. Signals from annunciators can similarly be used to activate functional features that may be needed under special circumstances, such as the release of electromagnetically-held doors.

Figure 2:
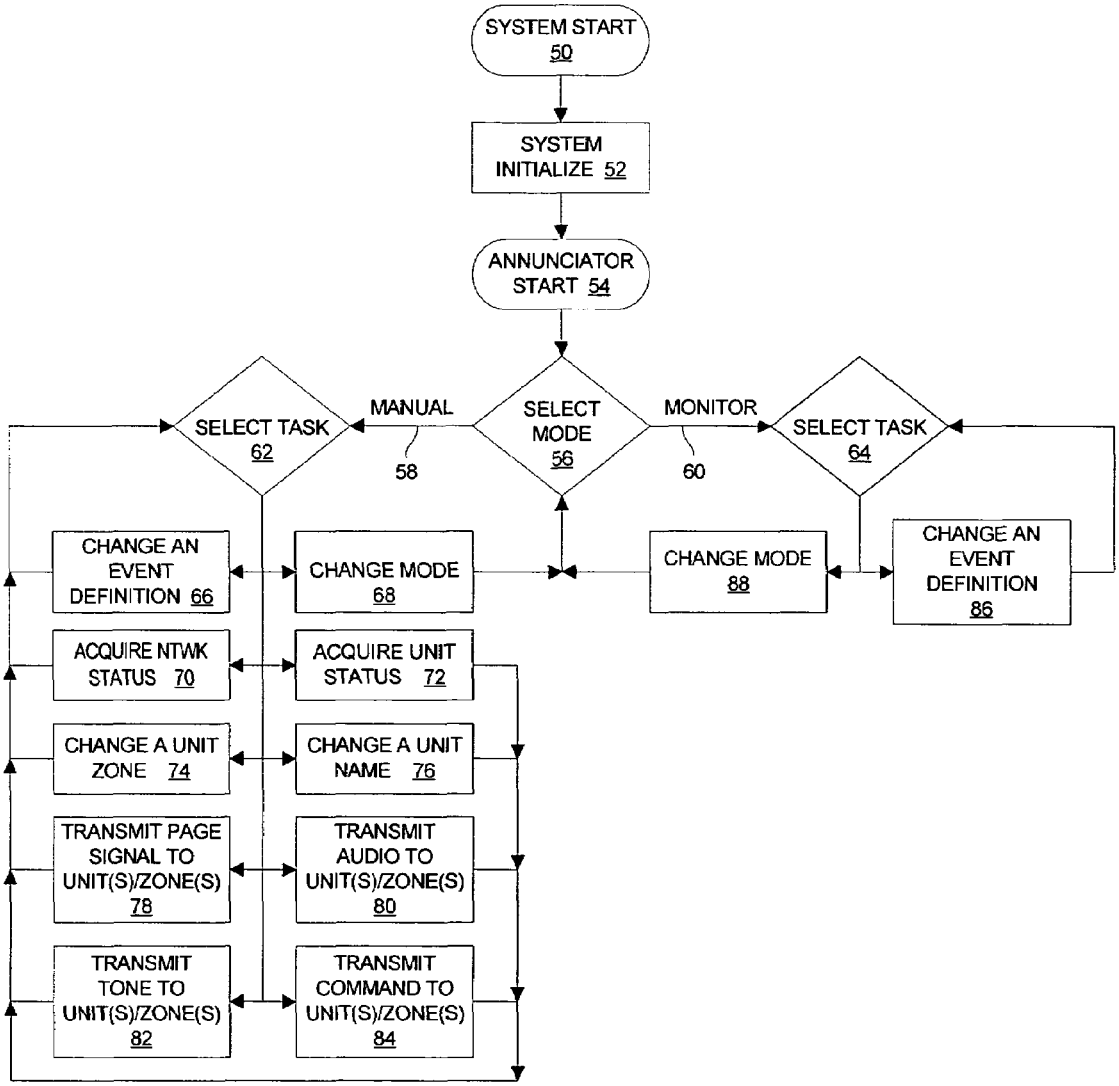
FIG. 2 is a software block diagram identifying functions that provide annunciator functionality in a central control processor-based annunciator system.

FIG. 2 shows functions of the central control processor. Since the processor in the exemplary system can be a general-purpose device, a Graphical User Interface supporting a general-purpose operating system, such as System X®, a Unix® flavor, or a Windows® flavor, can be employed to provide basic functionality and access to resources. Thus, after a system start event 50 such as power application, the initialization routine 52 can bring central control processor system memory, display, and interface resources on line before invoking 54 the annunciator control software to execute the annunciator central control. The core functional loop of the annunciator control software is the mode loop decision 56 to run in Manual 58 or Monitor 60 mode. Once this decision is made, the mode loop effectively repeats until changed by user intervention.

In Manual mode, a task select decision 62 can permit the user to choose between setup options, namely changing an event definition 66; acquiring network status 70; acquiring unit status 72; changing a unit's zone assignment 74; changing a unit's name as displayed 76; transmitting a paging signal to at least one unit or at least one zone 78; transmitting an audio signal to at least one unit or at least one zone 80; transmitting a tone signal to at least one unit or at least one zone 82; transmitting a command to at least one unit or at least one zone 84; or, following completion of a task, permitting changing mode 68.

Monitor mode in the preferred embodiment consists principally of a loop in which polling of all annunciators identified as active occurs at a regular rate, such as once every half-minute. In Monitor mode, a task select decision 64 can permit the user to change an event definition 86 or, following completion of that operation, to remain in that activity or change mode 88.

Figure 3:
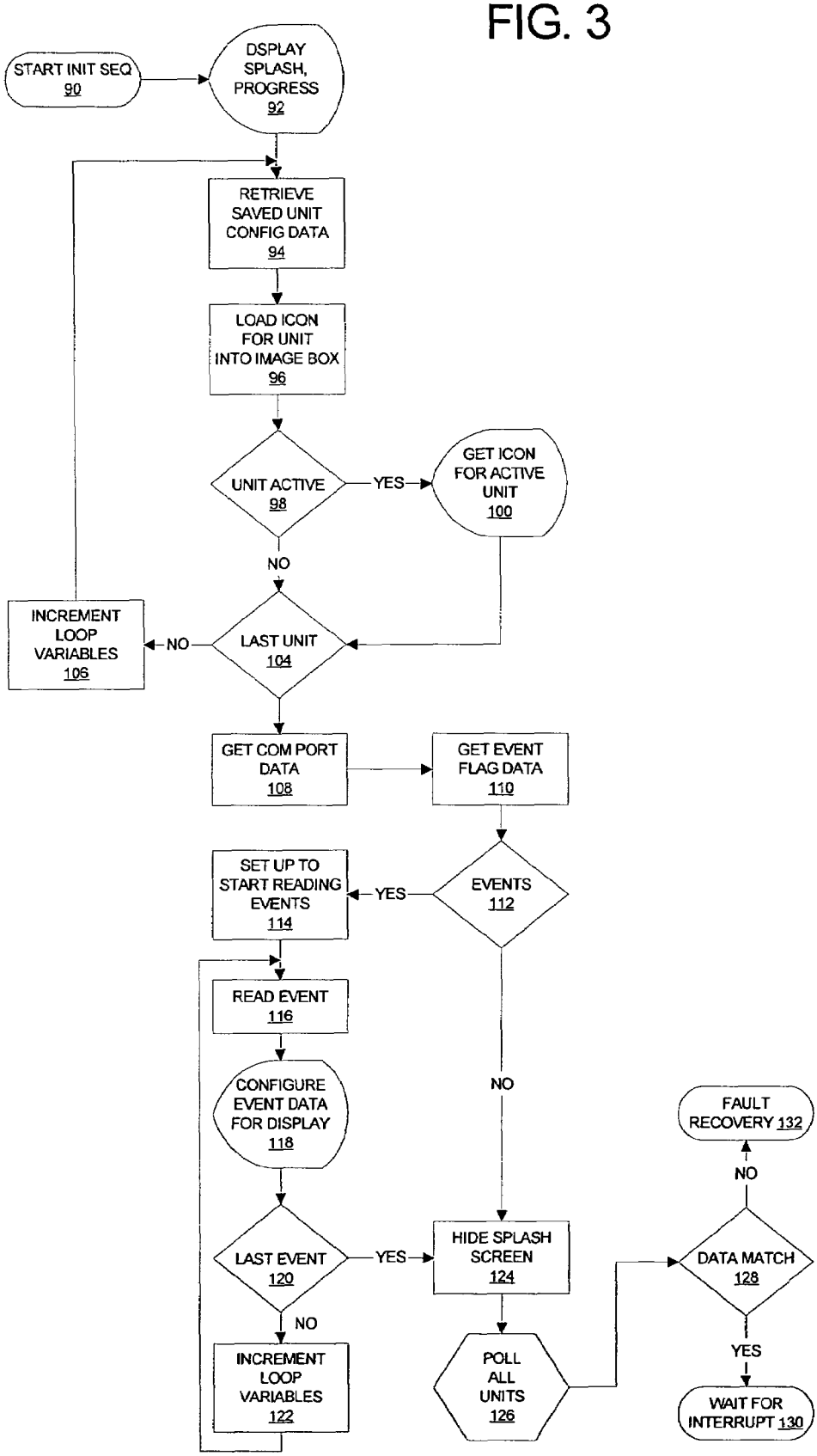
FIG. 3 is a software flowchart identifying an initialization sequence for a central control processor operating multiple remote annunciators.

FIG. 3 details an initialization sequence for exemplary annunciator control software. From the invocation 90, there can be an initial display 92, commonly termed a splash screen, during software loading. The initial display 92 can further include a progress bar, that is, an uncalibrated display bargraph on which the bar advances to suggest the nearness to completion of initialization. Settings for variables used in initialization can be those established during software installation or can be default values. Those variables whose values have been most recently modified and saved, such as unit-by-unit address, zone, name, activity status, and type information, can be recalled from nonvolatile memory during the step of retrieving saved configuration 94. After this, the step of loading 96 the icon representing each unit into the Image Box can build an accurate display of the system hardware configuration.

As further shown in FIG. 3, for each unit addressed, if that unit is operational 98, the icon showing its type can be displayed 100 and the unit activation loop tested for completion 104. Until all addresses have been analyzed, the loop is incremented 106 and the initialization continues.

Continuing FIG. 3, further system properties loaded 108 from an initialization file in nonvolatile memory can include communications port properties such as baud rate, handshaking conventions, parity, and stop bit rules as applied. Such data items relate to the use of a standard RS-232 serial port or another equivalent port to establish communication between the central control processor and the RS-485-linked annunciators.

Further initialization file data can include determination of existence 110 of event flags that require time dependent response. Where event flags exist 112, for each flag 114, data such as day code, day, date, unit, tone, start time, stop time, start string, stop string, and startup flag can be loaded 116, and displayed 118. Until 120 all flags have been loaded, the loop variables can be incremented 122 and the acquisition continued. Once all flags from the initialization file are loaded, initialization is essentially complete.

At this point during initialization, the splash screen can be disabled 124 and all units can be polled to confirm 126 that the current configuration agrees with that loaded from the data files. If all data agree 128, then the initialization sequence is complete and the system can wait for an interrupt 130 to pick up its next function. If there are errors, a fault recovery routine can be invoked 132.

Figure 4:
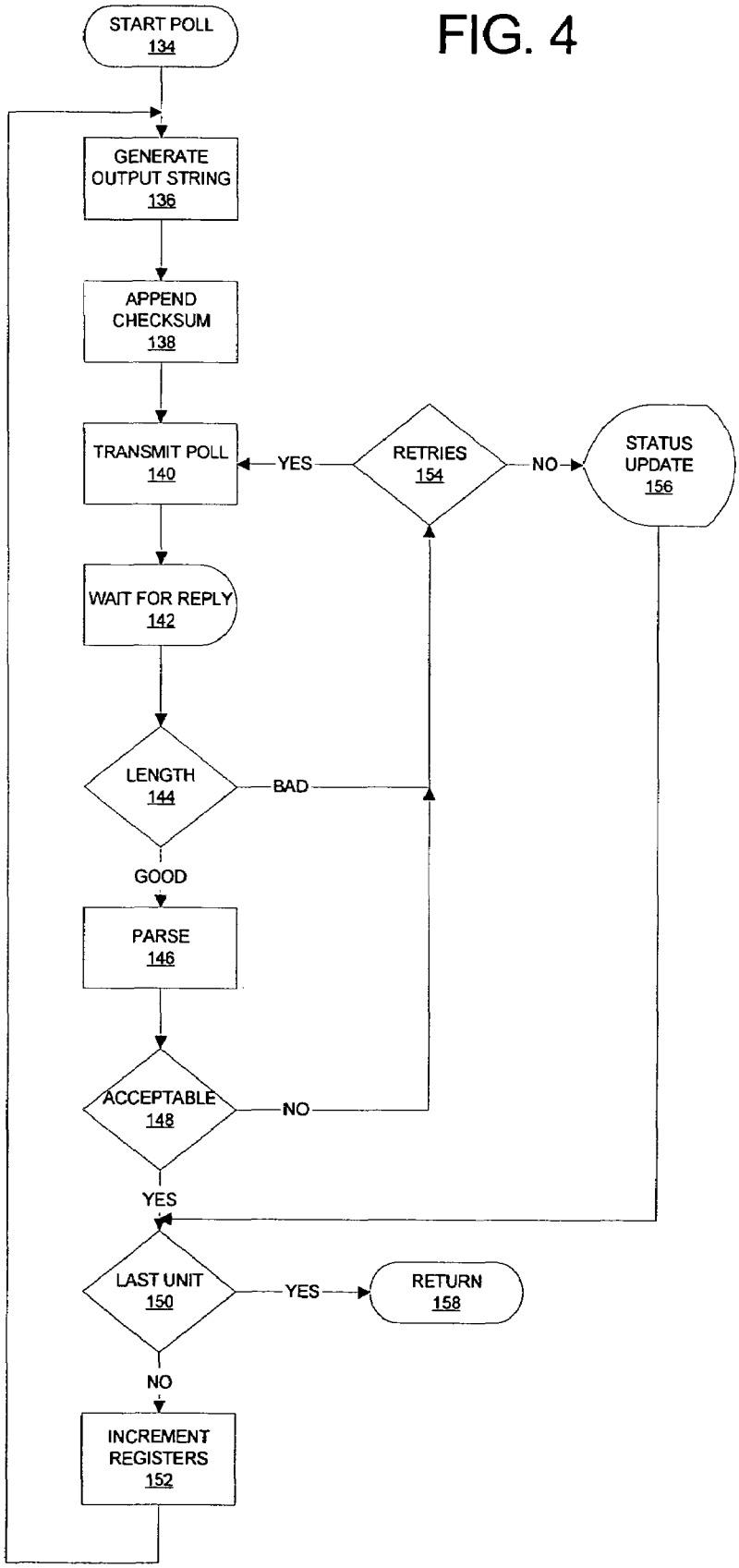
FIG. 4 is a software flowchart identifying steps in polling a single annunciator.

FIG. 4 displays the polling function referred to above. For a single annunciator, invoking polling 134 can generate an output 136 comprising an address and zone and a request for identity, followed by a checksum 138 to assure integrity. The signal so transmitted 140 can pass through central control processor hardware 12 to the converter 14 and transmission lines 16 to the polled annunciator 22. The addressed annunciator 22 may reply; the software can allow a hold 142 long enough to allow the signal to pass out through the parallel-to-serial function of RS-232 and the converter, internal processing within the polled annunciator, and a transmission back through the signal path. If a reply arrives and has the correct gross characteristics 144, it can be parsed 146 and evaluated for content 148. If the content is valid, loop incrementing can proceed, with a test 150 for end of sequence, incrementing of variables 152, and repeating for the next annunciator. At the end of all polling, the function can return 158 to a calling routine.

If the content is invalid or the gross characteristics are in error, retransmission may be performed if the remaining number of retries is greater than zero 154. If further retries are not allowed, the annunciator status can be marked bad or inactive 156 and polling can continue. A null response by the end of the hold 142 is a gross characteristic of error 144 and can advance the retry loop 154.

Figure 5:
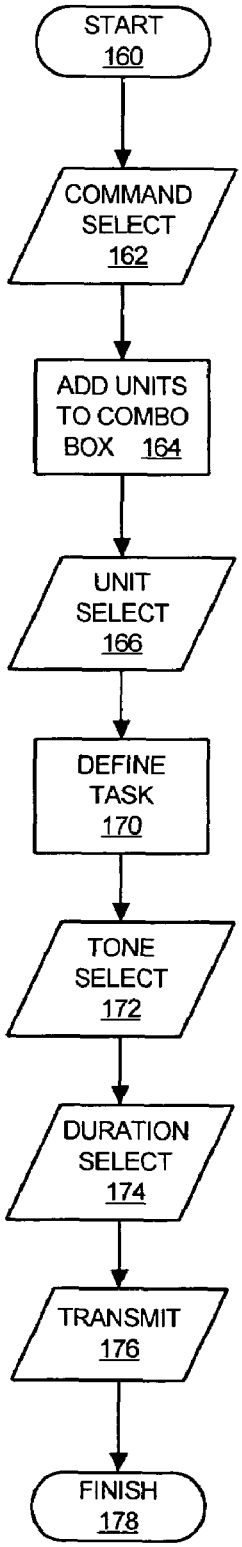
FIG. 5 is a software flowchart summarizing steps in sending a single tone of fixed duration to one annunciator.

FIG. 5 shows a representative transmission to a single annunciator commanding a single tone of specified properties, including pitch and duration. When invoked 160, the program can prompt the user to enter the appropriate command type 162. Units capable of being activated for that command are identified and their identification entered into a list termed the combo box 164. The user may then specify a unit by filling in a field or picking from a list a unit to be accessed 166, depending on details of implementation. The software can define the operation further 170, identifying the zone to which the unit has been assigned and using that information to fill in the user interface data display, performing transmission setup operations, and the like.

The next indicated operation is selection 172 of the tone to be emitted. This can, for example, be chosen by the user from a dropdown list, typed in, or otherwise entered from the possible range for the unit in question. If the entry is open ended, as in a typed-in field, then it may be necessary to perform a verification test; if the entry is a dropdown list, then the verification step 166 may not be required for unit selection.

The last setup operation in the exemplary operation shown is selection of duration 174. As in the cases indicated above, this can be a selection from a dropdown or other list, or can be filled in and verified. As implemented in the exemplary embodiment, a duration setting of zero can be defined as a signal to turn on the tone generator and leave it on. For the exemplary embodiment, a separate command can be provided to turn the tone generator off. Alternative embodiments can implement an equivalent function by such methods as assigning a continuous tone command, which can for example include a datum indicating that the tone starts or ends as a response to reception of the continuous tone command.

Setup can be followed by activation. Where that applies, the transmit command 176 can be issued by a mouse click on a software button, by a keystroke, or by other means. Since this step ends the routine in the exemplary embodiment, the finish step 178 may typically comprise a return to a calling routine.

Figure 6:
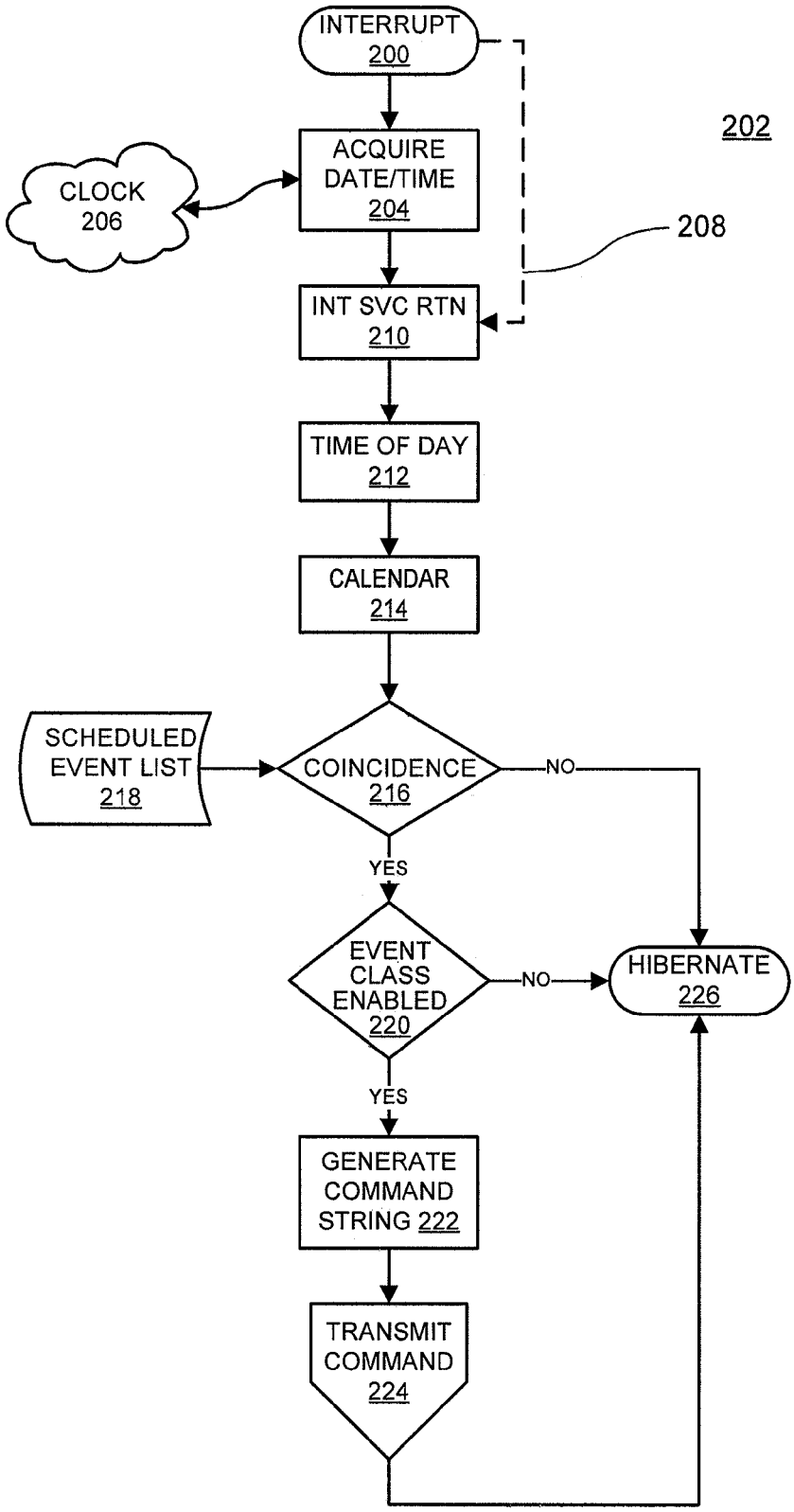
FIG. 6 is a software flowchart identifying steps in integrating time computations in an annunciator system.

FIG. 6 shows in flowchart form a basic service routine to support a clock-based annunciator system. One of the essential functions of an automated annunciator system is timekeeping; periodic timekeeping interrupts 200 initialize a timekeeping service routine 202. At each timekeeping interrupt 200, the timekeeping service routine 202 acquires a date-time message 204 from a high-precision clock 206.

The clock 206 may be any suitable type. For systems requiring high timekeeping confidence, atomic clocks with high internal stability and clocks that can monitor broadcast clock signals, including compensation for variations in atmospheric delays, may provide superior long-term stability, lower risk of internally generated error, and more certain recovery after a system abnormality.

As further shown in FIG. 6, timekeeping interrupts 200 can function as system interrupts 208. So functioning, they initiate interrupt service routines 210, which can recover the date-time messages 204 and break them down into time of day 212 and calendar 214 fields and check 216 for coincidence with a scheduled transmission, the properties of which may have been assigned in a setup sequence and are thus predefined when operating within procedure shown. If there is an event 218 scheduled for the current time interval, and if that class of event is enabled 220, then a command string can be generated 222 and transmission 224 can occur. If the outgoing transmission is one not requiring a response from the annunciators to which it is directed, such as a specific tone of fixed duration, then the task ends as soon as the transmission 224 is complete, and the system can enter a holding period commonly referred to as hibernating 226, until the next time interrupt.

Figure 7:
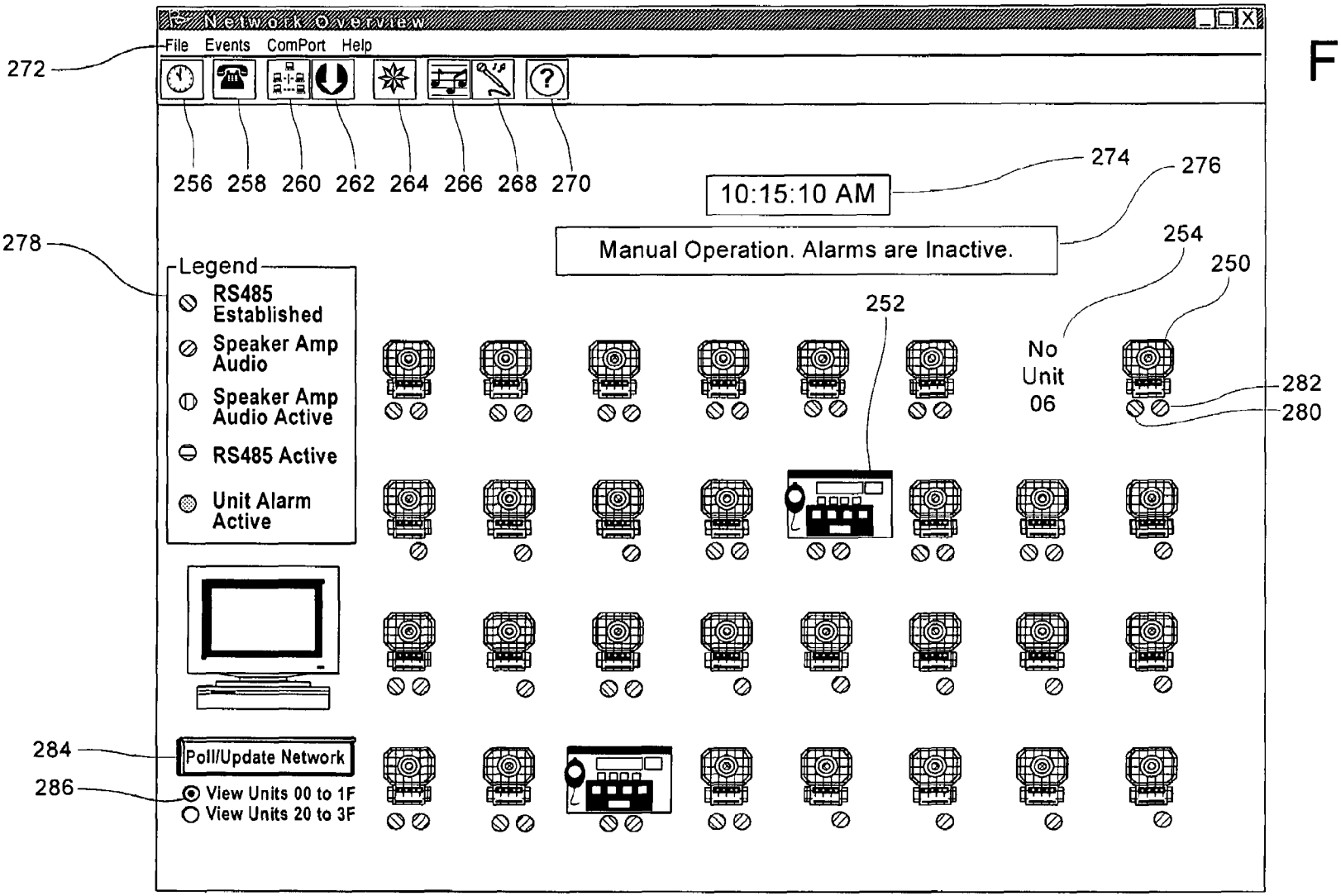
FIG. 7 is a screen shot showing a nominal system with multiple annunciators configured in a variety of modes.

FIG. 7 illustrates a representative user interface display, in which icons representing annunciators 250 and remote panels 252 provide immediate confirmation of the existence of individual units. An uninstalled unit address 254 is so listed in memory, is confirmed when polled, and is so displayed. Buttons allow keyboard or mouse click access to functions such as Timed Event Creation/Editing 256, communication Com Port configuration 258, network polling/updating 260, quick removal of noncommunicating units and remapping of the entire network 262, controlling entry and exit to the Monitor mode 264, tone selection 266, access to prerecorded voice segments 268, and access to help screens 270. Pull-down menus 272 are shown for subjects File, Events, ComPort, and a repeat of Help; these can be repeats in text form of individual functions that have button access, and can offer additional functions less often needed, as is common in GUI-based systems.

FIG. 7 further illustrates that clock time 274 can be displayed continuously, along with a text summary of system status 276. The Legend block 278 provides a reminder of the interpretations of colors, here illustrated by hatching patterns, associated with status information. As indicated, this permits high density of status summary, rapid familiarization, and rapid detection of discrepancies.

Beneath each icon, two dots, color-coded as shown in the Legend 278, can indicate type and status of individual annunciators. The presence of the leftmost dot 280 in the exemplary embodiment indicates that the unit is either a speaker amplifier 250 or a system panel 252, either of which can amplify sounds sent to it on the analog audio line. Absence of the leftmost dot 280 indicates that the unit is a tone generator, responding to commands to generate tones but not able to radiate analog signals. The rightmost dot 282 indicates RS485 status. The two dots 280 and 282 can change color in accordance with the Legend 278 depending on their status. For example, if RS485 communication with a specific annunciator has been established without error but is currently not active, that annunciator's right hand dot 282 will be yellow. During activity such as polling, the same dot 282 will change to green, indicating the activity, and then revert to yellow when the communication is over. Absence of the right hand dot 282 indicates that RS485 communication is in error or cannot be established.

In the exemplary embodiment, clicking on an annunciator serves to inquire as to its zone number, which shows up in a window.

The display may use unique icons to distinguish between physically similar speaker amplifiers and tone generators to reduce the need for indication of type by dots as shown in FIG. 7. Annunciators may be capable of both tone generation and analog amplification functions. Using multiple dots can eliminate need for color discrimination. The zone number can be displayed continuously instead of in response to an inquiry.

The Poll/Update Network soft button 284 allows substantially immediate, asynchronous polling of the status of all addresses. Soft buttons 286 can further permit selection between groups for systems which have more annunciators than readily fit on a screen. Reduction in icon size can permit more icons to be displayed at one time, and switching between low-and high-resolution icons—which zooms in to get more detail in a part of the display—can permit further increase in information density without making the display unreadable.

The arrangement in FIG. 7 shows the icons on a grid. In an alternative format, the user can position the icons to correspond to their physical locations, such as by floor in a multistory office building, aligned on an elongated factory floor, and other arrangements that can assist the user in visualizing system status.

An annunciator system according to the preferred embodiments can improve on previous annunciator systems. Existing-system central control processors are in many instances entirely manual, so that while they may support individual-annunciator, zone, and all-call addressing as well as auxiliary analog transmission, such central control processors may in practice reach an operability limit as the number of annunciators becomes large. Manual-only central control processors are in many instances virtually entirely lacking in the record keeping, dynamic configuration control, and user training and support functions that are intrinsic capabilities of systems using graphics-oriented central control processors.

Alternate central control processor hardware in some embodiments of the invention may take different physical form, such as placement of the equivalent of an off-the-shelf personal computer in a panel mounted configuration, and can feature a variety of user interface styles, such as a free-standing or embedded display; touch screen interface in lieu of or in addition to a mouse, trackball, joystick, touchpad, or other positioning device; and/or a keyboard that is free-standing, fold-down, or flush in the panel. Audio output for a user at the central control processor location can be implemented with speakers or headphone jacks.

Sound inputs can take a variety of forms as well. A sound card plugged into the off-the-shelf personal computer or the equivalent function embedded in the motherboard of such a computer can provide a sound output level controllable by the user either through the features of the GUI or through functions in the application software constituting the preferred embodiment. The high-level sound signal needed to send analog sound to whichever annunciators and subordinate panels can accept analog sound as an input can be provided by an off-the shelf, stand-alone amplifier or as part of a combined RS-485 and audio transmitter. Either such device can be installed in a panel-mount package, as a combination of desktop devices, or in another packaged system.

The RS-485 transceiver function for the central control processor is described in the first instance as a commercial RS-232 to RS-485 converter. This is one of several practical implementations, others of which include a dedicated circuit board within a personal computer and converters accepting non-RS-485 inputs, such as USB. While RS-485 is used in the preferred embodiment, other communications standards can be employed.

A second major change from established practice concerns addition of time data to annunciator systems. Whereas standard annunciator control panels are generally limited to being activated by sequences of manual button pushes, the preferred embodiment can schedule annunciator events an indefinite time into the future, can schedule events according to sequences whose complexity is excessive for performance by manual methods, can be set to occur once or to repeat daily, weekly, annually, or at any other interval, and can reconfigure dynamically, either for normal use or as a casualty response—for example, a particular annunciator can be assigned to one zone during the week and another on weekends, or a workspace within a zone can have music during second shift only; for a contrasting example, a system can be set up to change tones or reallocate annunciators between zones if other annunciators develop failure indications. The addition of time control allows reliable operation of large and complexly configured systems without need for active supervision by an operator. Detection and localization of at least some classes of failures can be speeded up. System setup and user training can each be performed offline, avoiding workplace distractions such as unexpected bells sounding during the workday.

The many features and advantages of the invention are apparent from the detailed specification, and, thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described; accordingly, all suitable modifications and equivalents may be resorted to that fall within the scope of the invention.

What is claimed is:

1. A programmable annunciator control system, comprising:

a set of stored-sequence executable instructions to implement functions of the annunciator control system;

an annunciator control unit capable of executing said stored-sequence executable instruction set;

a computer-readable clock to furnish timekeeping information to said annunciator control unit; and a set of annunciators controlled by said annunciator control unit;

wherein said annunciator control unit comprises a human interface subsystem supporting command and configuration input and display for said annunciator control unit, wherein said human interface subsystem comprises a microphone audio input device which converts sounds to electronic signals for further processing within said human interface subsystem; and a first sound signal processing device to convert electronic signals from said microphone audio input device into a form in which said audio input can be processed by said annunciator control unit;

a nonvolatile storage subsystem storing and retrieving data on behalf of said annunciator control unit; and a communications subsystem establishing a communication link between said annunciators and said annunciator control unit.

2. The programmable annunciator control system of claim 1, wherein said set of stored-sequence executable instructions further comprises:

a command routine;

a monitor routine;

a supervisor routine to evaluate and rank events reported by said monitor routine;

a system status report generator;

a realtime data backup and storage routine, wherein said realtime data backup and storage routine records a succession of system status reports in a nonvolatile storage, as generated by said system status report generator; and a configuration status display routine for generating a display output representing said command routine and said system status reports.

3. The programmable annunciator control system of claim 2, wherein said monitor routine is installed in said annunciator control unit.

4. The programmable annunciator control system of claim 2, wherein said monitor routine responds to each system event.

5. The programmable annunciator control system of claim 2, wherein said human interface subsystem further comprises:

a video display, whereupon said display output of said configuration status display routine can be displayed;

a keyboard data entry device wherewith data and commands comprising keystrokes may be entered; and a mouse data entry device, wherewith position data and mouse-click data may be entered.

6. The programmable annunciator control system of claim 1, wherein said set of stored-sequence executable instructions further comprises a scheduling sequence permitting multiple signal transmissions to be made at preselected times.

7. The programmable annunciator control system of claim 1, wherein said set of stored-sequence executable instructions further comprises a scheduling sequence permitting a multiplicity of command signals to be broadcast, wherein each command signal may be directed to any of the set of annunciators and may have any selectable combination of attributes.

8. The programmable annunciator control system of claim 1, wherein said human interface subsystem further comprises:

an audio output signal generator; and a second sound signal processing device to convert an audio output from a form in which said audio output can be generated by said annunciator control unit into a form in which said audio output can be carried by said audio output signal generator.

9. The programmable annunciator control system of claim 1, wherein said nonvolatile storage subsystem further comprises a disk drive, interface electronics, and operating software.

10. The programmable annunciator control system of claim 1, wherein said nonvolatile storage subsystem further comprises nonvolatile, solid-state read-write memory (NVRAM) and interface electronics.

11. The programmable annunciator control system of claim 1, wherein said nonvolatile storage subsystem further comprises an external storage device.

12. The programmable annunciator control system of claim 1, wherein said communications subsystem further comprises a bidirectional communications port and interface electronics.

13. The programmable annunciator control system of claim 1, wherein said communications subsystem further comprises an RS-485 bidirectional differential serial peripheral communications port and interface electronics.

14. The programmable annunciator control system of claim 1, wherein said communications subsystem further comprises an RS-232 bidirectional single-ended serial peripheral communications port and interface electronics.

15. The programmable annunciator control system of claim 1, wherein said set of annunciators further comprises at least one annunciator that senses, interprets, executes, and replies to commands from said command routine.

16. The programmable annunciator control system of claim 1, wherein said set of annunciators further comprises at least one annunciator that senses, interprets, executes, and replies to those commands from said command routine that are addressed uniquely to said annunciator.

17. The programmable annunciator control system of claim 1, wherein said set of annunciators further comprises at least one annunciator that senses, interprets, executes, and replies to those commands from said command routine that are addressed to a group including said annunciator as designated by zone.

18. The programmable annunciator control system of claim 1, wherein said set of annunciators further comprises at least one annunciator that senses, interprets, executes, and replies to those commands from said command routine that are addressed to all annunciators as designated by an all-call addressing indicator.

19. The programmable annunciator control system of claim 1, wherein a polling routine interrogates and acquires status reports from said annunciators.

20. A programmable annunciator control system, comprising:

means for processing electronic signals;

means for annunciating messages in response to signals from said processing means;

means for communicating between said processing means and at least one said annunciating means;

means for assigning each of said annunciating means to at least one zone in accordance with user-defined criteria;

means for measuring clock time in a form readable by said processing means;

means for scheduling command events affecting at least one of said annunciating means;

means for activating command events affecting at least one of said annunciating means; and means for recovering system configuration information from automated records of the status of at least one annunciating means maintained in nonvolatile storage media.

21. The programmable annunciator control system of claim 20, further comprising means for sending audio signals to at least one of said annunciating means.

22. The programmable annunciator control system of claim 20, further comprising means for interrogating at least one of said annunciating means by a self-timed interrogation routine initiated at a predetermined time.

23. The programmable annunciator control system of claim 20, further comprising means for recording and evaluating the status of a plurality of said annunciating means.

24. The programmable annunciator control system of claim 20, further comprising means for visually representing information related to at least one of the identity, functional properties, and condition of at least one of said annunciating means.

25. The programmable annunciator control system of claim 20, further comprising means for correcting a system time setting after a system operation interruption and restoral, where the source of time data used for said means for correcting is a broadcast time service.

* * * * *

UNITED STATES PATENT AND TRADEMARK OFFICE

CERTIFICATE OF CORRECTION

PATENT NO. : 7,408,442 B2
APPLICATION NO. : 10/664911
DATED : August 5, 2008
INVENTOR(S) : Raymond J. LeBlanc et al.

It is certified that error appears in the above-identified patent and that said Letters Patent is hereby corrected as shown below:

Title page:

Item [73]

Please insert --GE Security, Inc., Bradenton, FL (US)--.

Signed and Sealed this

Fourth Day of November, 2008

JON W. DUDAS
*Director of the United States Patent and Trademark Office*